US006026889A

United States Patent [19]

Pase, Sr.

[11] Patent Number: 6,026,889

[45] Date of Patent: Feb. 22, 2000

[54] SINGLE SHELL BOILER

[75] Inventor: Glennwood K. Pase, Sr., Gloucester, N.J.

[73] Assignee: Joseph Oat Corporation, Camden, N.J.

[21] Appl. No.: 09/099,311

[22] Filed: Jun. 18, 1998

[51] Int. Cl.[7] ..... F28D 15/00

[52] U.S. Cl. ..... 165/104.21; 165/112; 202/264; 122/33

[58] Field of Search ..... 165/104.21, 104.33; 202/264; 122/33

[56] References Cited

U.S. PATENT DOCUMENTS

| | | | |
|---|---|---|---|
| 1,069,394 | 8/1913 | Cozzolino | 202/264 |
| 1,123,392 | 1/1915 | Schmidt | 165/104.21 |
| 2,119,091 | 5/1938 | Atkinson et al. . | |
| 2,313,087 | 3/1943 | Parr et al. | 165/104.21 |
| 3,174,540 | 3/1965 | Dutton . | |
| 3,581,811 | 6/1971 | Julie . | |
| 3,698,476 | 10/1972 | Wyzalek et al. | 165/112 |
| 3,994,336 | 11/1976 | Pessolano et al. . | |
| 4,117,806 | 10/1978 | Manning . | |
| 4,343,763 | 8/1982 | McGuire . | |
| 5,103,899 | 4/1992 | Kalina . | |
| 5,375,153 | 12/1994 | Patterson et al. . | |
| 5,529,115 | 6/1996 | Paterson . | |
| 5,871,043 | 2/1999 | Osakabe et al. | 165/104.33 |

FOREIGN PATENT DOCUMENTS

| | | |
|---|---|---|
| 52-52261 | 4/1977 | Japan . |
| 53-34157 | 3/1978 | Japan . |
| 61-173083 | 8/1986 | Japan . |
| 738053 | 5/1980 | Russian Federation . |
| 901807 | 1/1982 | Russian Federation . |
| 901808 | 1/1982 | Russian Federation . |

*Primary Examiner*—Ira S. Lazarus
*Assistant Examiner*—Terrell McKinnon
*Attorney, Agent, or Firm*—Akin, Gump, Strauss, Hauer & Feld, L.L.P.

[57] ABSTRACT

An improved single shell boiler is provided. The single shell boiler includes a closed vessel for containing a liquid heat transfer medium, with the liquid heat transfer medium having a surface. A first bundle of heat source tubes is located in the closed vessel and is adapted to be submerged within the liquid heat transfer medium for heating and vaporizing the liquid heat transfer medium. A second bundle of tubes is located in the closed vessel in a position which is adapted to be above the level of the liquid heat transfer medium within the vessel to receive heat by condensation of vaporized heat transfer medium on the second bundle of tubes. A condensate distribution plate is positioned between the first and second bundles of tubes. The condensate distribution plate is adapted to approximately evenly distribute condensate droplets released by the second bundle of tubes to break-up froth on the surface of the liquid heat transfer medium to enhance vapor release from the liquid heat transfer medium.

14 Claims, 4 Drawing Sheets

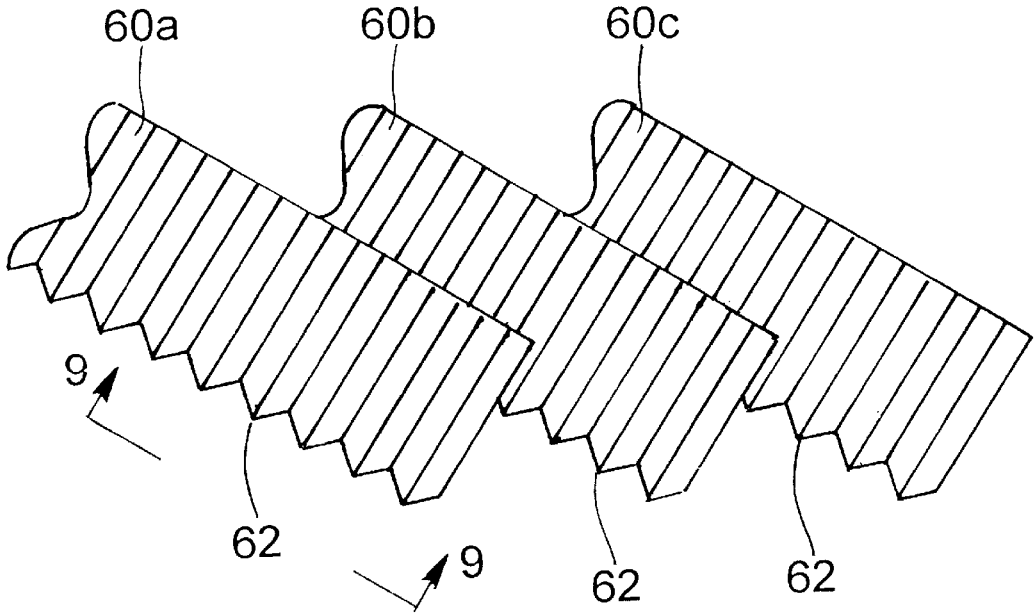
Fig. 8
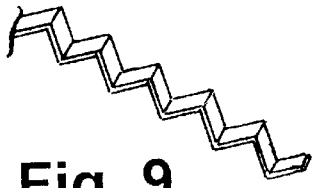
Fig. 9
Fig. 7
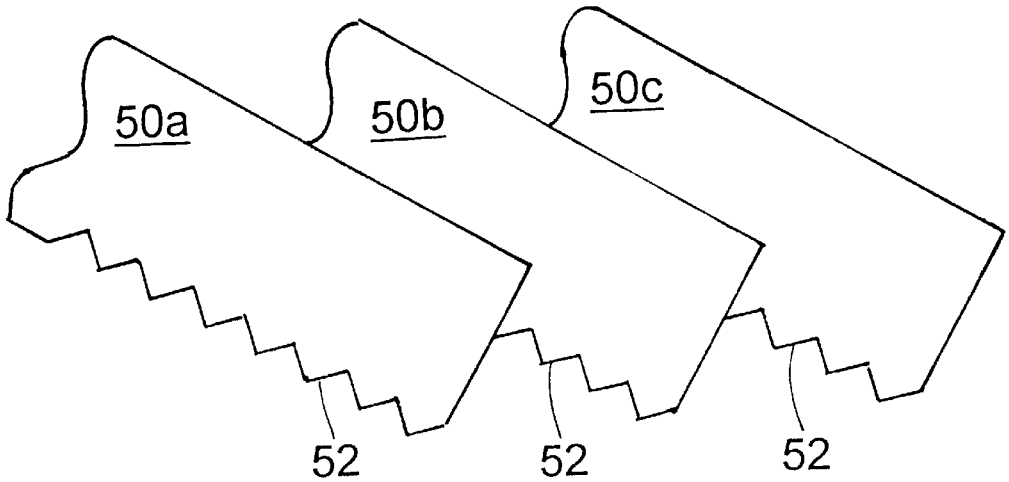

SINGLE SHELL BOILER

BACKGROUND OF THE INVENTION

The present invention relates to an apparatus for indirect heat transfer between two liquids, and more particularly, to single shell boilers used for heat transfer between first and second isolated tube bundles located within the shell using a liquid heat transfer medium.

Heat exchangers for indirect heat transfer between two liquids are generally known, for example as shown in U.S. Pat. No. 2,119,091. Such heat exchangers are typically located within a closed vessel and include a first bundle of tubes for carrying a liquid which acts as a heat source and a second bundle of heat receiving tubes for carrying a liquid which is to be heated indirectly from the heat source via a heat transfer medium located within the vessel.

One known heat exchanger, shown in cross-section in FIG. 1, provides a heat source tube bundle 2 at the bottom of a closed vessel 3 which is surrounded by the liquid heat transfer medium. Heat is transferred from the heat source tubes 2 to the liquid heat transfer medium such that the liquid heat transfer medium boils, releasing vaporized heat transfer medium from the surface. The vaporized heat transfer medium is then carried by thermal convection to the second bundle of tubes 4. The vaporized heat transfer medium condenses on the second bundle of tubes 4 transferring heat through the second bundle of tubes 4 to the liquid medium carried by the second bundle of tubes 4. Condensate droplets of the heat transfer medium then drip from the second bundle of tubes 4 back to the pool of liquid heat transfer medium surrounding the first bundle of heat source tubes 2.

Typically, a layer of froth forms on the pool of liquid heat transfer medium. The froth inhibits the release of vaporized heat transfer medium from the surface. Additionally, the liquid heat transfer medium surrounding the heat source tube bundle is stratified with the hottest, highest pressure liquid heat transfer medium being located at the bottom of the vessel. This also reduces the efficiency of heat transfer to the liquid medium to be heated in the second tube bundle.

It is desirable to provide a means for reducing the layer of froth in the known system in order to improve the release of vaporized heat transfer medium as well as to reduce or eliminate the stratification in the liquid heat transfer medium to improve the heat transfer efficiency.

BRIEF SUMMARY OF THE INVENTION

Briefly stated, the present invention provides an improved single shell boiler. The single shell boiler includes a closed vessel for containing a liquid heat transfer medium, with the liquid heat transfer medium having a surface. A first bundle of heat source tubes is located in the closed vessel and is adapted to be submerged within the liquid heat transfer medium for heating and vaporizing the liquid heat transfer medium. A second bundle of tubes is located in the closed vessel in a position which is adapted to be above the level of the liquid heat transfer medium within the vessel to receive heat by condensation of vaporized heat transfer medium on the second bundle of tubes. A condensate distribution plate is positioned between the first and second bundles of tubes. The condensate distribution plate is adapted to approximately evenly distribute condensate droplets released by the second bundle of tubes to break-up froth on the surface of the liquid heat transfer medium to enhance vapor release from the liquid heat transfer medium.

In another aspect, the present invention provides a single shell boiler having a closed vessel for containing a liquid heat transfer medium having a surface. A first bundle of heat source tubes is located in the closed vessel and is adapted to be submerged within the liquid heat transfer medium for heating and vaporizing the liquid heat transfer medium. A second bundle of tubes is located in the closed vessel in a position which is adapted to be above the surface of the liquid heat transfer medium within the vessel to receive heat by condensation of vaporized heat transfer medium on the second bundle of tubes. The first bundle of heat source tubes is arranged to include a plurality of flow channels between the heat source tubes which are arranged in the first bundle to encourage dynamic flow of the liquid heat transfer medium through the first bundle of tubes to reduce surface foam on the liquid heat transfer medium.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 7 is a perspective view of leafed distributor plates which can be used in connection with the single shell boiler in accordance with the present invention;

FIG. 8 is a perspective view of corrugated, leafed distributor plates which can be used in connection with the single shell boiler in accordance with the present invention;

FIG. 9 is an end view taken along lines 9—9 in FIG. 8;

DETAILED DESCRIPTION OF THE INVENTION

Figure 1:
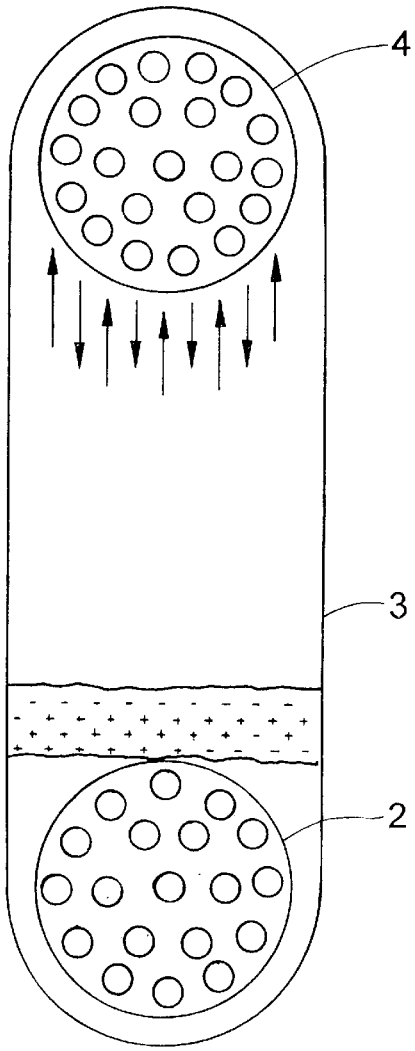
Fig. 1 (PRIOR ART)
FIG. 1 is a cross-sectional view of a single shell boiler in accordance with the known prior art.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the single shell boiler 10 in accordance with the present invention, and designated parts thereof. The terminology includes the words specifically mentioned above, derivatives thereof and words of similar import.

Referring to the drawings, wherein like numerals indicate like elements throughout, there is shown in FIGS. 2–5 a preferred embodiment of a single shell boiler 10 in accordance with the present invention. The single shell boiler 10 includes a closed vessel 12 for containing a liquid heat transfer medium 14 having a surface 16, which is preferably above a minimum predetermined level in the vessel 12. The closed vessel 12 may be made of various types of material, such as stainless steel, sheet metal, or selected polymeric materials, depending upon the liquid heat transfer medium 14 being used and the working temperature of the liquid heat transfer medium 14. Those skilled in the art will recognize from the present disclosure that the vessel 12 will include access openings for charging and maintenance, as well as feed and return connections for the bundles of tubes located within the vessel. However, the specific configuration of these connectors is not pertinent to the present invention, and the configuration can be varied as desired. Accordingly, a detailed description of these connections has been omitted for convenience only, and is not considered limiting.

Figure 2:
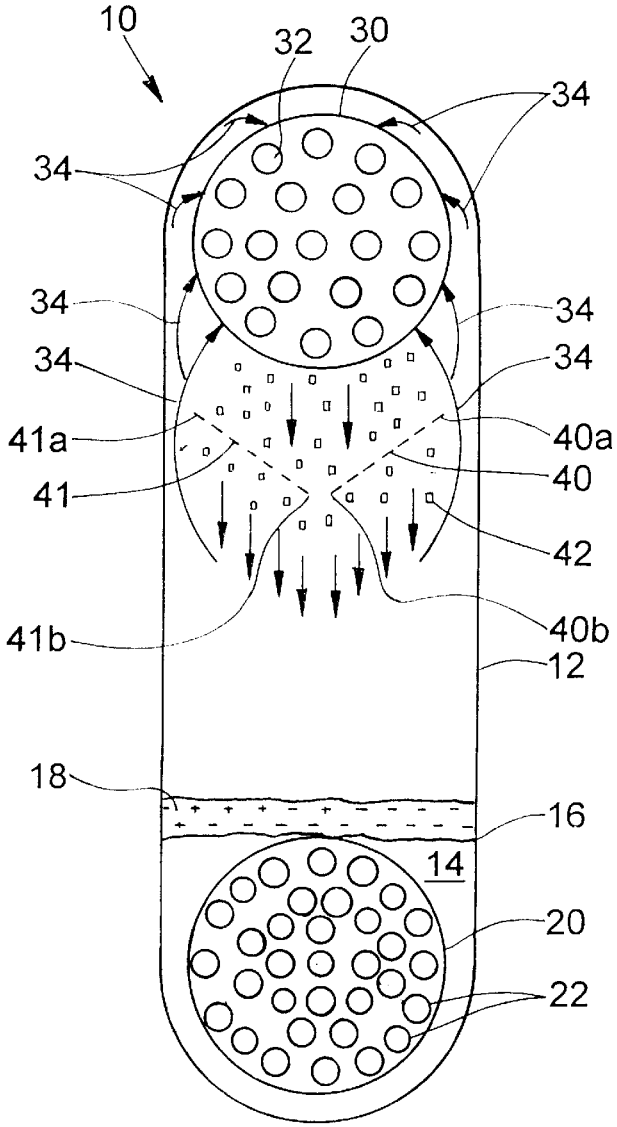
FIG. 2 is a cross-sectional view of a single shell boiler in accordance with the present invention.

Still with reference to FIG. 2, a first bundle 20 of heat source tubes 22 is located in the closed vessel 12. The first bundle 20 of heat source tubes 22 is adapted to be submerged within the liquid heat transfer medium 14 for heating and vaporizing the liquid heat transfer medium 14. In one preferred embodiment, the heat source tubes are 0.75 inch outside diameter tubes made of stainless steel or other suitable metallic materials, which are spaced on 1.0 inch centers. Preferably, the first bundle 20 of heat source tubes 22 is approximately two feet to five feet in diameter, depending upon the particular application. It will be recognized by those skilled in the art from the present disclosure that the size of the tubes 22, the spacing between the tubes 22, as well as the size of the first bundle 20 can be varied depending upon the particular application. Feed and return connections (not shown) are provided for the first bundle 20 of tubes 22 for circulating a heated fluid to the first tube bundle 20.

A second bundle 30 of tubes 32 is also located within the closed vessel 12. The second bundle 30 of tubes 32 is located in a position which is adapted to be above the surface 16 of the liquid heat transfer medium 14 within the vessel 12 to receive heat by condensation of the vaporized heat transfer medium 14, represented as arrows 34, on the second bundle 30 of tubes 32. The size and spacing of the tubes 32 in the second bundle 30, as well as the overall dimensions of the second bundle 30, are preferably the same as in the first bundle 20. However, it will be recognized by those skilled in the art from the present disclosure that the size and spacing of the tubes 32, as well as the overall size of the second bundle 30, can be varied as desired depending upon the particular application.

As shown in FIG. 2, a condensate distribution plate 40, and more preferably two condensate distribution plates 40, 41, are positioned between the first and second bundles 20, 30 of tubes 22, 32. The condensate distribution plate 40 is adapted to approximately evenly distribute condensate droplets 42 released by the second bundle of tubes 32. The condensate droplets 42 fall in the direction indicated in FIG. 2 due to gravity and break-up froth on the surface 16 of the liquid heat transfer medium 14 to enhance vapor release from the heat transfer medium 14. By distributing the condensate droplets 42 more evenly, the froth over the entire surface 16 of the liquid heat transfer medium 14 is more evenly dispersed.

Figure 3:
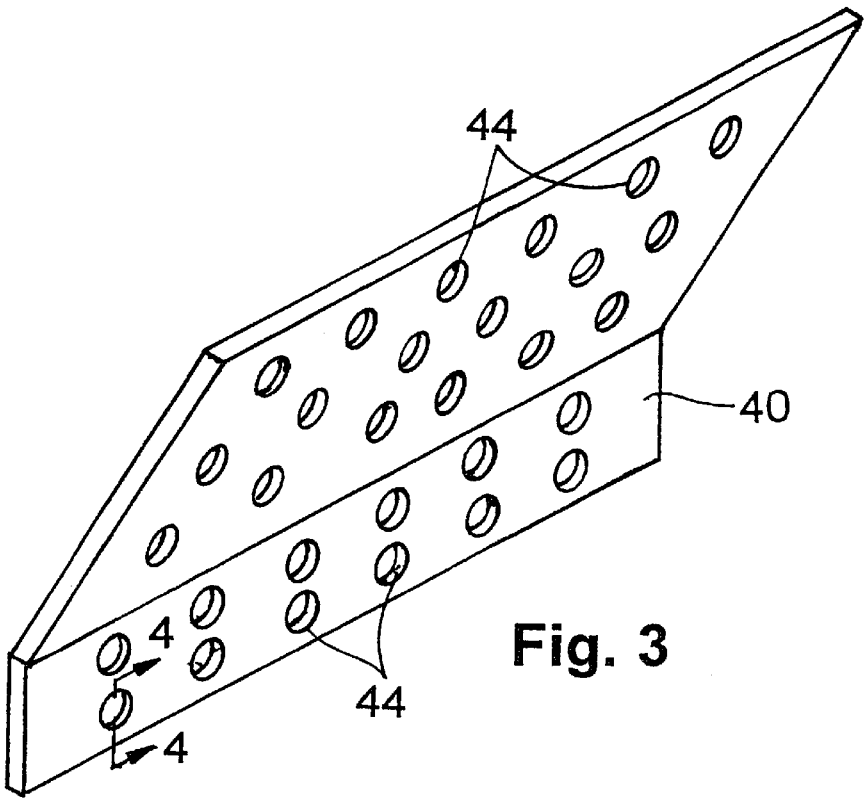
FIG. 3 is a perspective view of a condensate distribution plate used in connection with the single shell boiler in accordance with the present invention shown in FIG. 2.
Figure 6:
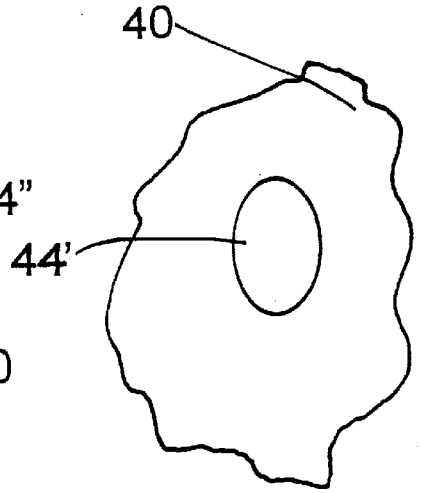
FIG. 6 is an elevational view of an alternate embodiment of a stripper in accordance with the present invention.

As shown in FIG. 3, preferably the condensate distribution plate 40 includes a plurality of apertures 44 defined therethrough. The apertures 44 are arranged to approximately evenly distribute condensate droplets 42. The apertures 44 may be in the form of an elongate tear drop-shaped opening 44' as shown in FIG. 6. The elongate shape is provided to prevent bridging of condensate droplets across the aperture 44' due to surface tension of the condensate.

Figure 5:
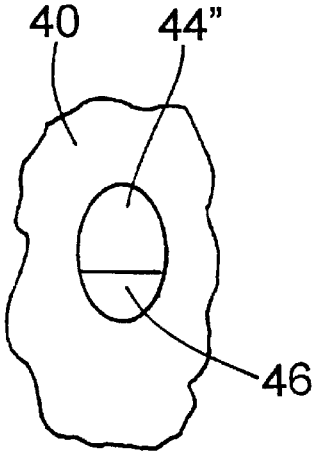
FIG. 5 is an elevational view taken along line 5—5 in FIG. 4.
Figure 4:
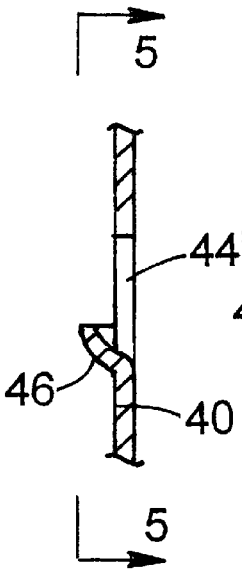
FIG. 4 is a cross-sectional view of a stripper taken along line 4—4 in FIG. 3.

Alternatively, as shown in FIGS. 4 and 5, the aperture 44" may include a stripper 46 located on the lower side of the aperture 44" which protrudes outwardly from the surface of the condensate distribution plate 40 in an eyebrow shape in order to direct condensate droplets which bridge across the aperture 44" to the bottom side of the condensate distribution plate 40 in order to ensure uniform distribution. Each stripper 46 is preferably formed of the same material as the condensate distribution plate 40 by punching or forming a portion of the material used to form the opening 44" outwardly to form the eyebrow-shaped projection along the lower portion of the aperture 44". It will be recognized by those skilled in the art from the present disclosure that the shape of the stripper can be varied, as long as it protrudes outwardly from the surface of the condensate distribution plate 40 to direct condensate droplets which could possibly bridge an opening 44" through the plate 40.

As shown in FIG. 2, when two condensate distribution plates 40, 41 are provided, each condensate distribution plate 40, 41 preferably includes a plurality of apertures 44 defined therethrough, with the apertures 44 being arranged to approximately evenly distribute condensate droplets 42. Each plate 40, 41 has a top edge 40*a*, 41*a*, and a bottom edge 40*b*, 41*b*. The bottom edge 40*b*, 41*b* of each plate is positioned in a generally central location within the vessel 12 at a level which is lower than the top edge 40*a*, 41*a* such that the two plates 40, 41 are in a generally V-shaped arrangement, as shown. However, it will be understood by the skilled artisan that a single condensate distributor plate 40 or other arrangement of multiple condensate distribution plates may be used, as explained in more detail below.

The condensate distribution plates 40, 41 may be made of any suitable material, such as stainless steel, metal or a polymeric material depending upon the working temperature range and type of heat transfer medium 14 being used.

Referring now to FIG. 7, a second embodiment of the condensate distribution plate is shown. In the embodiment shown in FIG. 7, the condensate distribution plate comprises a plurality of leafed distributor plates 50*a*, 50*b*, 50*c*. The leafed distributor plates 50*a*, 50*b*, 50*c* are arranged to evenly distribute condensate droplets 42 across the surface 16 of the heat transfer medium 14 by being located between the first and second bundles 20, 30 of tubes 22, 32, in a similar manner to the condensate distribution plate 40.

Preferably, the bottom edge of each leafed distributor plate 50*a*, 50*b*, 50*c* includes a plurality of serrations 52 which cause the condensate droplets 42 to be evenly shed as opposed to pooling or traveling to a common discharge point. The leafed distributor plates 50*a*, 50*b*, 50*c* may be arranged horizontally, or may be inclined in a generally V-shaped arrangement, if desired.

Referring now to FIGS. 8 and 9, a third embodiment of a condensate distribution plate is shown. In the third embodiment, leafed distributor plates 60*a*, 60*b*, 60*c* similar to the leafed distributor plate 50*a*–50*c* are provided. Each leafed distribution plate 60*a*–60*c* is corrugated, with the corrugations extending between the top and bottom edges. The bottom edge is also preferably serrated as shown. Preferably, the bottom edge of each leafed distributor plate 60*a*–60*c* is positioned closer to the first bundle 20 of tubes 22 than the top edge, such that the leafed distributor plates 60*a*–60*c* are oriented at an angle to the surface 16 of the liquid heat transfer medium 14.

It will be recognized by those skilled in the art that the number and spacing of the leafed distributor plates 50*a*–50*c*, 60*a*–60*c* can be varied based on the size of the vessel 12 and the spacing between the first and second bundles 20, 30 of tubes 22, 32. It will be similarly recognized that groups of the leafed distribution plates 50*a*–50*c*, 60*a*–60*c* can be arranged in a generally V-shaped arrangement, if desired.

The even distribution of condensate droplets 42 helps to more evenly break up and disperse the layer of foam or froth 18 on the surface of the liquid heat transfer medium 14 to improve heat transfer efficiency of the single shell boiler 10 as compared to the known prior art single shell boilers. The V-shaped arrangement of the condensate distribution plates 40, 41, shown in FIG. 2, also helps the flow of vaporized heat transfer medium 34 around to the sides and top of the second bundle 30 of tubes 32 carrying the liquid which is to be heated. Those skilled in art will recognize that other types of condensate distribution plates may also be utilized for evenly distributing condensate droplets 42 on the surface 16 of the liquid heat transfer medium 14 which would fall within the scope of the present invention.

Figure 10:
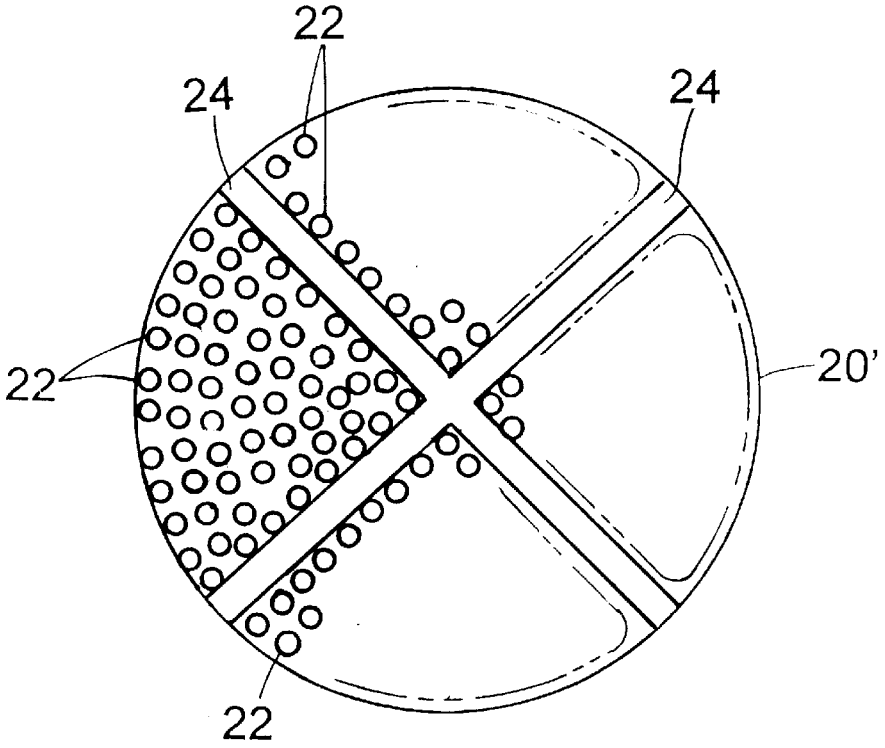
FIG. 10 is an enlarged cross-sectional view of a first bundle of heat source tubes arranged to include a plurality of flow channels in accordance with the present invention.

As shown in FIG. 10, in order to further improve the efficiency of the single shell boiler 10 of the type shown in FIG. 2, the first bundle 20' of heat source tubes 22 is arranged to include a plurality of flow channels 24 between the heat source tubes 22 to encourage dynamic flow of the liquid heat transfer medium 14 around the tubes 22 to reduce surface foam 18 through the enhanced dynamic movement of the liquid heat transfer medium 14. In the arrangement shown in FIG. 10, the flow channels 24 are generally arranged in a cross shape to increase dynamic flow around the first bundle of tubes 22. This is achieved due to the fact that the liquid heat transfer medium 14 of the bottom of the vessel 12 is at a higher temperature and pressure than the liquid at the surface due to the higher static head.

In one preferred embodiment, 0.75 outside diameter inch tubes located on 1.0 inch centers were used to define the tube field. Flow channels 24 which are three times the diameter of the tubes (or 2.25 inches) were arranged in a cross shape in the tube field in order to increase the upward flow of the higher pressure, higher temperature liquid heat transfer medium at the bottom of the vessel 12 to the surface 16. This resulted in a reduced thickness foam layer 18 on the surface 16 of the liquid heat transfer medium 14 due to the enhanced circulation and the increase in non-uniform turbulence along the surface 16 of the liquid heat transfer medium 14.

Figure 11:
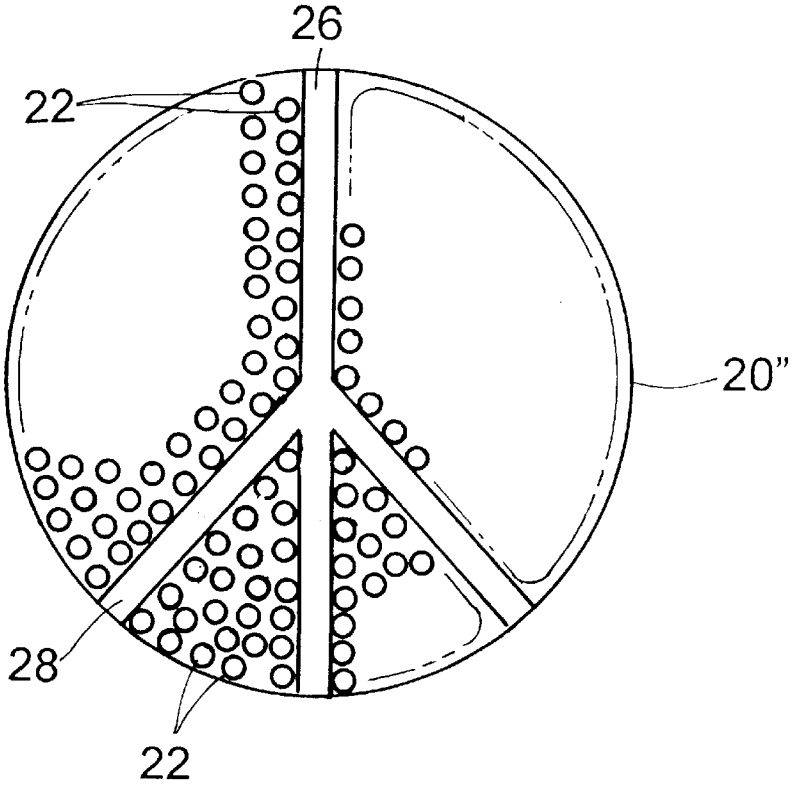
FIG. 11 is a cross-sectional view of an alternate embodiment of the first bundle of heat source tubes which include a plurality of flow channels in accordance with the present invention.

Referring now to FIG. 11, a second embodiment of an improved arrangement for the first bundle 20" of heat source tubes 22 is provided. In the second embodiment, flow channels are provided which include a generally vertical flow channel 26 and to lower channels 28, each of which extends from a lower periphery of the first bundle 20" of heat source tubes 22 to a generally central location in the tube bundle that intersects the vertical flow channel 26. This arrangement also helps to reduce the thickness of the surface foam 18 on the liquid heat transfer medium 14 due to the hotter, higher pressure liquid heat transfer medium 14 circulating through the tube bundle 20" and up to the surface.

It will be recognized by those skilled in the art from the present disclosure that an improved single shell boiler 10 with a higher heat transfer efficiency can be obtained by using either or both of the condensate distribution plate 40 or the flow channels 24, 26, 28 in the first bundle 20', 20" of heat source tubes 22.

In one preferred arrangement, a single shell boiler 10 in accordance with the present invention having condensate distribution plates 40, 41 and a first bundle 20' of tubes which included flow channels 24 was used for heating liquid natural gas, including butane, propane and/or methane, stored at −190° F. in a ship prior to transfer into a land based pipeline. Sea water at 70° F. was pumped through the first bundle 20 of heat source tubes 22 in order to boil a liquid refrigerant, used as the liquid heat transfer medium 14, to heat the liquid natural gas in the second bundle 30 of tubes 32. The liquid natural gas was heated to approximately 50° F. to avoid temperature shock to the land based pipeline prior to the liquid natural gas entering the pipeline.

Those skilled in the art will recognize from the present disclosure that the improved single shell boiler of the present invention can be used in any application where heat is being transferred between two isolated systems by a heat transfer medium in order to increase the heat transfer efficiency.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A single shell boiler comprising:

a closed vessel for containing a liquid heat transfer medium, the liquid heat transfer medium having a surface;

a first bundle of heat source tubes located in the closed vessel which is adapted to be submerged within the liquid heat transfer medium for heating and vaporizing the liquid heat transfer medium;

a second bundle of tubes located in the closed vessel in a position which is adapted to be above the surface of the liquid heat transfer medium within the vessel to receive heat by condensation of vaporized heat transfer medium on the second bundle of tubes;

a condensate distribution plate positioned between the first and second bundles of tubes, said condensation distribution plate having a plurality of apertures therethrough, the apertures being arranged to approximately evenly distribute condensate droplets released by the second bundle of tubes to break-up froth on the surface of the liquid heat transfer medium to enhance vapor release from the medium; and a stripper located adjacent to each aperture to prevent bridging of condensate droplets across each said aperture.

2. The single shell boiler of claim 1 wherein two condensate distribution plates are provided, each plate having a plurality of apertures defined therethrough, the apertures being arranged to approximately evenly distribute condensate droplets, each plate having a top edge and a bottom edge, the bottom edge of each plate being positioned in a generally central location within the vessel at a level which is lower than the top edge such that the two plates are in a generally V-shaped arrangement.

3. The single shell boiler of claim 1 wherein the condensate distribution plate comprises a plurality of leafed distributor plates.

4. The single shell boiler of claim 3 wherein the bottom edge of each leafed distributor plate includes a plurality of serrations.

5. The single shell boiler of claim 3 wherein each leafed distributor plate is corrugated, and the corrugations extend between the top and bottom edges.

6. The single shell boiler of claim 3 wherein each leafed distributor plate has a top edge and a bottom edge, and the bottom edge of each leafed distributor plate is positioned closer to the first bundle of tubes than the top edge such that the leafed distributor plates are oriented at an angle to the surface of the liquid heat transfer medium.

7. The single shell boiler of claim 6 wherein the bottom edge of each leafed distributor plate includes a plurality of serrations.

8. The single shell boiler of claim 6 wherein each leafed distributor plate is corrugated, and the corrugations extend between the top and bottom edges.

9. The single shell boiler of claim 1 wherein the first bundle of heat source tubes are arranged to include a plurality of flow channels between the heat source tubes to encourage dynamic flow of the liquid heat transfer medium through the tube field to reduce surface foam on the liquid heat transfer medium.

10. The single shell boiler of claim 9 wherein the flow channels are generally arranged in a cross shape.

11. The single shell boiler of claim 9 wherein the flow channels include a generally vertical flow channel which extends through the first bundle of heat source tubes, and two lower channels, each of which extends from a lower periphery of the first bundle of heat source tubes to a central location which intersects the vertical flow channel, the lower channels being located on opposite sides of the generally vertical channel.

12. A single shell boiler comprising:

a closed vessel for containing a liquid heat transfer medium, the liquid heat transfer medium having a surface;

a first bundle of heat source tubes located in the closed vessel which is adapted to be submerged within the liquid heat transfer medium for heating and vaporizing the liquid heat transfer medium;

a second bundle of tubes located in the closed vessel in a position which is adapted to be above the surface of the liquid heat transfer medium within the vessel to receive heat by condensation of vaporized heat transfer medium on the second bundle of tubes;

the first bundle of heat source tubes being arranged to include a plurality of flow channels between the heat source tubes to encourage dynamic flow of the liquid heat transfer medium through first bundle of the tubes to reduce surface foam on the liquid heat transfer medium;

a condensate distribution plate positioned between the first and second bundles of tubes, said condensation distribution plate having a plurality of apertures therethrough, the apertures being arranged to approximately evenly distribute condensate droplets released by the second bundle of tubes to break-up froth on the surface of the liquid heat transfer medium to enhance vapor release from the medium; and a stripper located adjacent to each aperture to prevent bridging of condensate droplets across each said aperture.

13. The single shell boiler of claim 12 wherein the flow channels are arranged in a cross shape.

14. The single shell boiler of claim 12 wherein the flow channels include a generally vertical flow channel which extends through the first bundle of heat source tubes, and two lower channels, each of which extends from a lower periphery of the first bundle of heat source tubes to a central location which intersects the vertical flow channel, the lower channels being located on opposite sides of the generally vertical channel.

* * * * *